United States Patent [19]

Hirasawa

[11] Patent Number: 5,028,836

[45] Date of Patent: Jul. 2, 1991

[54] COLOR CATHODE RAY TUBE OF SHADOW MASK TYPE

[75] Inventor: Shigemi Hirasawa, Chiba, Japan

[73] Assignee: Hitachi, Ltd., Tokyo, Japan

[21] Appl. No.: 397,134

[22] Filed: Aug. 22, 1989

[30] Foreign Application Priority Data

Sep. 9, 1988 [JP] Japan ..... 63-224606

[51] Int. Cl.[5] ..... H01J 29/07

[52] U.S. Cl. ..... 313/402; 313/407

[58] Field of Search ..... 313/402, 407

[56] References Cited

U.S. PATENT DOCUMENTS 4,442,376 4/1984 Van Der Waals et al. ..... 313/402
4,864,188 9/1989 Sugai et al. ..... 313/402

FOREIGN PATENT DOCUMENTS 56-59433 of 1981 Japan ..... 313/402
57-9184 of 1982 Japan .
60-14459 of 1985 Japan .
61-6969 of 1986 Japan .

*Primary Examiner*—Sandra L. O'Shea
*Attorney, Agent, or Firm*—Antonelli, Terry, Stout & Kraus

[57] ABSTRACT

A color cathode ray tube of the shadow mask type capable of reducing the color unbalance due to the doming phenomenon of shadow mask is disclosed, in which a material having a low thermal conductivity is vacuum-deposited on that main surface of a shadow mask which exists on the electron gun side, to prevent heat due to electron bombardment from being transmitted to the shadow mask in a short time, and the material is prevented from being deposited on that side wall of each of electron-beam transmitting holes of the shadow mask which confronts an electron gun, to suppress the generation of scattered electrons at the side wall. Thus, in the above color cathode ray tube, the color unbalance due to the thermal expansion of the shadow mask is prevented, and moreover there is not any fear of degrading the picture quality of a displayed image by halation.

19 Claims, 3 Drawing Sheets

COLOR CATHODE RAY TUBE OF SHADOW MASK TYPE

BACKGROUND OF THE INVENTION

The present invention relates to a color cathode ray tube of the shadow mask type capable of reducing the doming phenomenon of a shadow mask, and more particularly to a color cathode ray tube, in which a material having a low thermal conductivity is vacuum-deposited on the main surface existing on the electron gun side of a shadow mask.

When a color cathode ray tube of the shadow mask type is operated, a shadow mask is bombarded with an electron beam. Hence, the shadow mask is heated, and thus expanded. In a case where the whole of the shadow mask is uniformly heated and expanded, the positional relation between the shadow mask and a fluorescent screen can be kept unchanged, by appropriately selecting the structure and material of a member for supporting the shadow mask. That is, it is possible to prevent the adverse effect of the thermal expansion of the shadow mask on the picture quality of a displayed image.

As is well known, the shadow mask is formed of a thin metal plate. Accordingly, in a case where a local area of the fluorescent screen becomes very bright, that is, a large current is supplied to the local area, it is impossible to dissipate a large amount of heat generated in that portion of the shadow mask which corresponds to the local area, in a short time by thermal conduction. That is, the above portion is thermally expanded in a great degree. Thus, the so-called "doming phenomenon" is generated, and color unbalance occurs. While, in a case where a local area of the fluorescent screen is very dark, that is, only a small amount of current is supplied to the local area, that portion of the shadow mask which corresponds to the local area, is thermally expanded only a little, and thus the doming effect and the color shading are hard to generate.

In order to solve the above problem, a method has been devised. In this method, as described in a Japanese Patent Publication No. 57-9,184, a heat insulating layer is formed on that surface of a shadow mask which is bombarded with an electron beam, other than electron-beam transmitting holes, and a thin metal film is formed on the heat insulating layer, to dissipate heat due to electron bombardment by thermal radiation from the thin metal film, thereby preventing the temperature of the shadow mask from rising. Thus, the color shading due to the thermal expansion of the shadow mask can be prevented.

Further, according to another conventional method, as described in Japanese Patent Publication Nos. 60-14,459 and 61-6,969, an electron reflecting layer made of an element with a high density (namely, large specific gravity) is formed on that surface of a shadow mask which exists on the electron gun side, to prevent electrons from penetrating into the interior of the shadow mask, thereby preventing the kinetic energy of each electron from being converted into thermal energy. Specifically, it is disclosed in the Japanese Patent Publication No. 60-14,459 that a solution containing a heavy metal with an atomic number more than 70 is sprayed on that surface of the shadow mask which exists on the electron gun side, while being sucked from the fluorescent screen side, to form the electron reflecting layer on that surface of the color selection electrode of the shadow mask which exists on the electron gun side. In this case, however, the solution adheres to the wall of each of electron-beam transmitting holes, since the solution is sprayed on the surface of the shadow mask from the electron gun side. Hence, the electron reflecting layer is formed on the wall of each hole, and thus halation appears on the fluorescent screen.

Further, it is disclosed in the above-referred Japanese Patent Publication No. 61-6,969 that the electron reflecting film having a thickness of about 10 μm and made of an element which has a density greater than the density of a substance making the color selection electrode of the shadow mask, or a compound containing the above element, is formed on that surface of the color selection electrode which is irradiated with the electron beam. In this case, there is a fear that the shape of each of electron-beam transmitting holes of the color selection electrode is changed by the electron reflecting layer.

Further, the above-mentioned conventional, methods pay no special attention to manufacturing technology and cost, and hence it is very difficult to mass-produce a desired color cathode ray tube by these conventional methods.

SUMMARY OF THE INVENTION

It is a main object of the present invention to provide a color cathode ray tube, in which the doming phenomenon of a shadow mask is prevented in a simple, inexpensive manner.

It is another object of the present invention to provide a color cathode ray tube which can display a clear image without generating color unbalance due to the deformation of a shadow mask.

It is a further object of the present invention to provide a color cathode ray tube, in which a layer having a low thermal conductivity is formed on only a peripheral portion of a shadow mask to reduce the manufacturing cost of the color cathode ray tube.

According to the present invention, bismuth having a low thermal conductivity is deposited on that surface of a shadow mask which exists on the electron gun side, to prevent heat which is generated by electron beam bombardment, from being transmitted to the shadow mask in a very short time. Even in a case where the shadow mask is thermally expanded, the electrons passing through a central portion of the shadow mask do not generate color shading. Accordingly, when bismuth is deposited only on a peripheral portion of the shadow mask, the manufacturing cost of a color cathode ray tube can be reduced without degrading the picture quality of a displayed image. Further, in a case where bismuth is deposited on the side wall of each electron-beam transmitting holes of the shadow mask and the side wall of the hole is bombarded with the electron beam, many electrons are scattered from the side wall of the hole, and the scattered electrons degrade the picture quality of a displayed image. In view of the above fact, according to the present invention, bismuth is deposited on the electron-beam receiving surface of the shadow mask so as not to be deposited on that side wall of each electron-beam transmitting hole which confronts an electron gun.

Bismuth has a thermal conductivity of 0.0192 cal $cm^{-2} sec^{-1} deg^{-1}$ at 20° C. While, the shadow mask is usually made of iron, which has a thermal conductivity of 0.10 to 0.15 cal $cm^{-2} sec^{-1} deg^{-1}$ at room temperature. That is, the thermal conductivity of bismuth is less than one-fifth that of iron. Further, bismuth is excellent in safety and stability, and low in price. Thus, bismuth layer formed on that surface of the shadow mask which exists on the electron gun side, can serve as a heat insulating layer, and thus can prevent a local area of the shadow mask from being heated in a great degree in a very short time. That is, the thermal expansion of the local area can be prevented.

In vacuum, bismuth particles have a long mean free path, and, can go straight in a wide space. That is, unlike a spray in air, the bismuth particles in vacuum do not make a zigzag motion. Hence, when bismuth is evaporated under vacuum in a state that a central portion of the shadow mask hides behind a shielding member when viewed from an evaporation source, bismuth can be deposited only on a peripheral portion of the shadow mask.

DESCRIPTION OF THE PREFERRED EMBODIMENT

Figure 1:
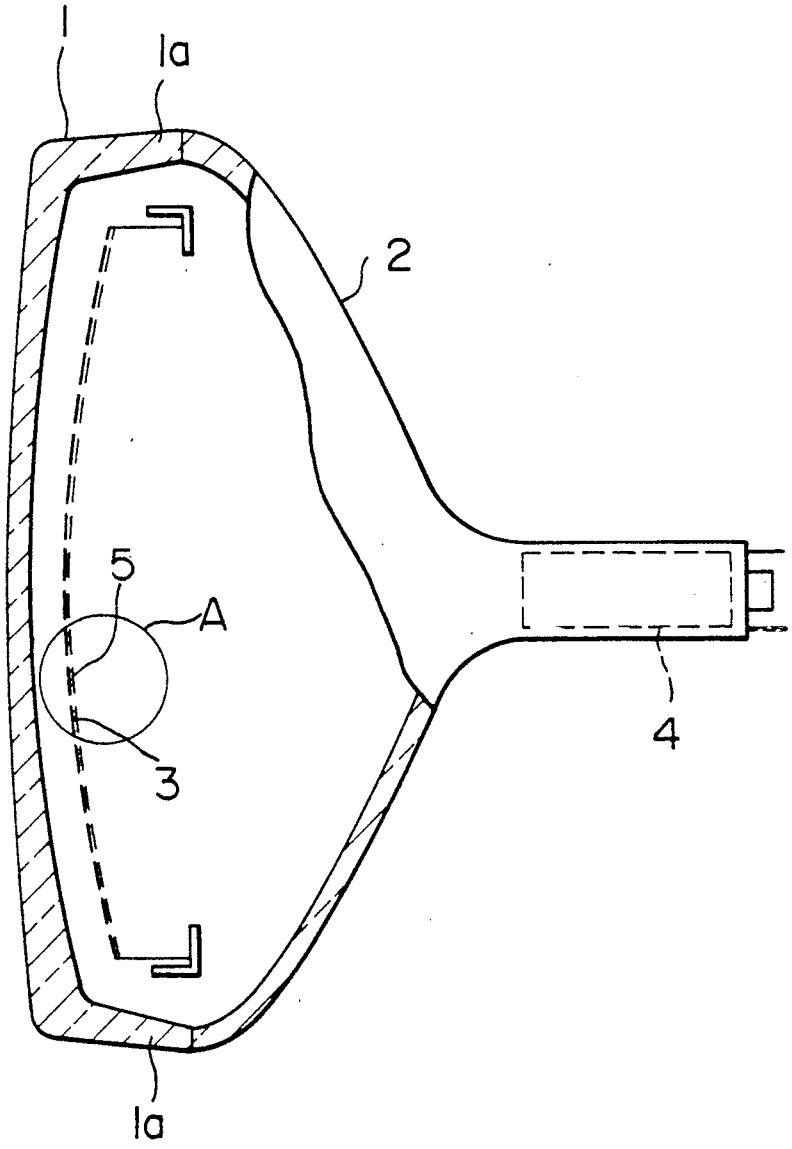
FIG. 1 is a partially cutaway view of a color cathode ray tube of the shadow mask type, to which the present invention is applied.

FIG. 1 is a schematic diagram, with portions broken away and in section, of a color cathode ray tube of the shadow mask type, to which the present invention is applied. It is to be noted that members having no connection with the present invention are omitted from FIG. 1. In FIG. 1, reference numeral 1 designates the panel of a glass bulb, 2 the funnel portion of the glass bulb, 3 a shadow mask, and 4 an electron gun. Referring to FIG. 1, an electron beam emitted from the electron gun 4 is deflected by a deflection system (not shown) so that a fluorescent screen (not shown) formed on the rear surface of the panel 1 is scanned with the electron beam. Thus, the phosphor on the fluorescent screen is excited by the electron beam, and emits light. The electron beam is continuously emitted from the electron gun during a scanning period other than a very short blanking period, and electrons passing through the electron-beam transmitting holes of the shadow mask 3 impinge on the fluorescent screen. Thus, the phosphor on the fluorescent screen emits light. However, about 80 percent of electrons reaching the shadow mask 3, collide with the shadow mask, and that portion of the shadow mask which is bombarded with the electrons is heated. Thus, the above portion is thermally expanded. In a case where the whole of the shadow mask is uniformly expanded, as has been already explained, the adverse effect of the thermal expansion of the shadow mask on the picture quality of a displayed image can be eliminated by appropriately selecting the structure and material of a member for connecting the shadow mask with the skirt portion (that is, side wall portion) la of the panel 1. In a Case where a local area of the fluorescent screen is very bright, that is, a large current is supplied to the local area, however, only that portion of the shadow mask which corresponds to the above local area, is intensively bombarded with the electron beam. The above portion is heated more than the remaining portion of the shadow mask, and thus the thermal expansion of the above portion is far greater than that of the remaining portion. Hence, the position of each of electron-beam transmitting holes included in the above portion will deviate from a normal position, and color unbalance will be generated.

Figure 2:
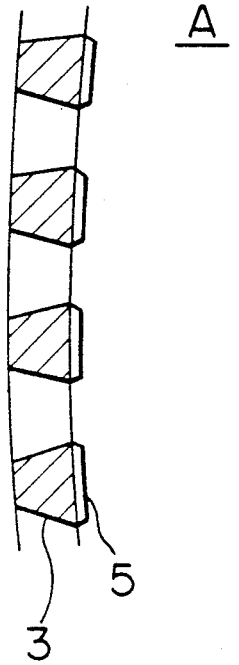
FIG. 2 is an enlarged view showing a portion of an embodiment of an inventive shadow mask included in the cathode ray tube of FIG. 1.

FIG. 2 is an enlarged view showing a portion A of an embodiment of the inventive shadow mask 3 of FIG. 1. Referring to FIG. 2, a bismuth layer 5 having a low thermal conductivity is deposited on that surface of the shadow mask 3 which exists on the electron gun side. Thus, the electron beam emitted from the electron gun does not collide with the shadow mask 3, but impinges on the bismuth layer 5. Hence, the bismuth layer 5 is heated. It is to be noted that bismuth is large in specific gravity, and hence is used as an electron reflecting substance in the above-referred Japanese Patent Publication Nos. 60-14,459 and 61-6,969. When a local area of the bismuth layer 5 is heated, the heat generated in the local area is not transmitted to the shadow mask 3 in a short time, since bismuth is low in thermal conductivity. Thus, there is little possibility of local expansion of the shadow mask. In television broadcasting, a moving picture is usually displayed, and it is seldom that a very bright image is displayed fixedly at a local area of the fluorescent surface for a long time. Accordingly, it is required to suppress the doming phenomenon for a relatively short time. That is, the doming phenomenon can be suppressed by depositing a layer with a low thermal conductivity on that surface of the shadow mask 3 which exists on the electron gun side. In order to suppress the doming effect even for a case where a highlight portion of an image stays at a limited area of the fluorescent screen for a long time, the shadow mask itself has to be made of, for example, invar (a nickel-iron alloy), which is high in price and hard to work, but small in coefficient of thermal expansion.

Figure 3:
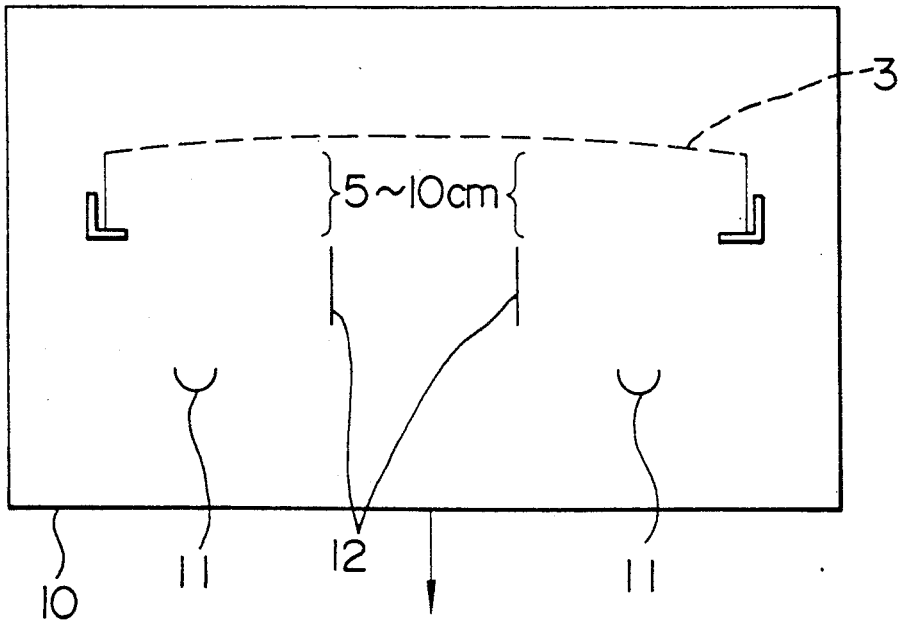
FIG. 3 is a schematic diagram which shows an evaporation apparatus for depositing bismuth on a shadow mask to form the embodiment of FIG. 2.
Figure 4:
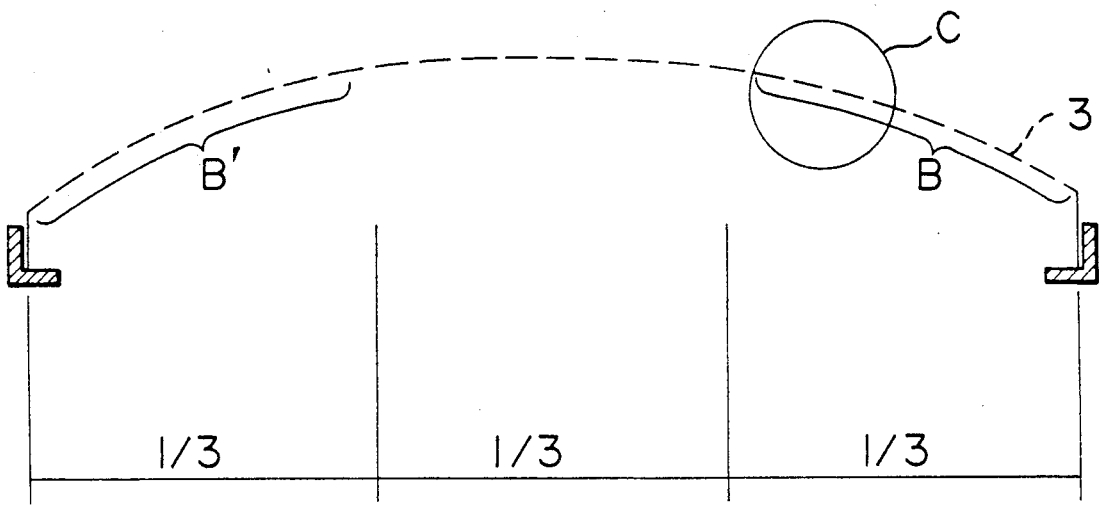
FIG. 4 is a schematic diagram showing those portions of a shadow mask where a bismuth layer is formed by the evaporation apparatus of FIG. 3.

FIG. 3 shows an evaporation apparatus for depositing bismuth on a shadow mask to obtain the present embodiment, and FIG. 4 shows those portions of the present embodiment where a bismuth layer is formed by the evaporation apparatus of FIG. 3. In FIG. 3, reference numeral 3 designates a shadow mask, 10 a vacuum vessel which is evacuated to a pressure of about $1\times10^{-4}$ Torr, 11 tungsten boats, each of which is loaded with bismuth particles and heated by resistance heating, to be used as an evaporation source, and 12 shielding members. First, let us consider a case where the shielding members 12 are removed. About 2 grams of bismuth are loaded in each boat 11, and then bismuth is evaporated so that a bismuth layer is deposited on the shadow mask 3 to a thickness of about 2 $\mu$m or less. When the shadow mask thus obtained is incorporated in a color cathode ray tube, the color cathode ray tube is about 30% smaller in doming phenomenon than a conventional color cathode ray tube.

As has been already mentioned, the color unbalance due to the doming phenomenon of shadow mask is scarcely generated at that central portion of the fluorescent screen where the electron beam impinges on the fluorescent screen in a direction perpendicular thereto. Accordingly, even when, as shown in FIG. 4, bismuth is deposited only on those peripheral portions B and B' of the shadow mask which have a width nearly equal to one-third the width of the shadow mask in a lengthwise direction, the doming effect of the shadow mask can be suppressed. In order to deposit bismuth only on the portions B and B' of the shadow mask, the shielding members 12 are disposed in the vacuum chamber 10 so as to be spaced apart from the shadow mask 3 a distance of about 5 to 10 cm. In this case, the boundary between the portion coated with bismuth and the uncoated portion becomes unclear, that is, the thickness of the bismuth layer 5 changes gradually in a boundary region between the bismuth coated portion and the uncoated portion. Thus, the thermal stress in the boundary region can be lessened.

When a bismuth layer is bombarded with an electron beam, many electrons are scattered from the bismuth layer. When the scattered electrons impinge on a fluorescent screen, there is a fear that the contour of a displayed image is blurred by halation. This problem can be solved in the following manner.

Figure 5:
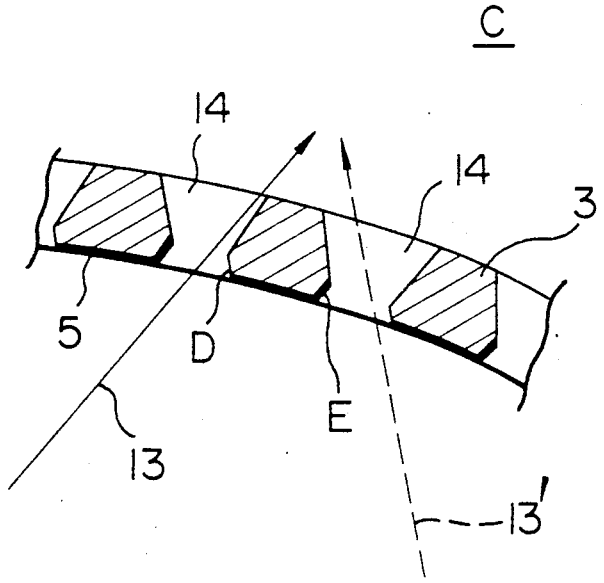
FIG. 5 is an enlarged view showing a part C of the shadow mask of FIG. 4.

FIG. 5 is an enlarged view showing a part C of the peripheral portion B of FIG. 4. Referring to FIG. 5, when an electron beam 13 scans the electron-beam transmitting holes 14 of the peripheral portion B, the electron beam 13 impinges on the right-hand wall D of each of the holes 14. Hence, when the bismuth layer 5 is formed on the shadow mask 3 by the evaporation apparatus of FIG. 3, the positions of the shielding member 12 and the evaporation source 11 are adjusted so that bismuth is not deposited on the right-hand wall of each electron-beam transmitting hole 14. In more detail, the bismuth layer 5 is formed on the peripheral portion B of the shadow mask 3 in such a manner that bismuth is not deposited on the right-hand wall D of each electron-beam transmitting hole 14 but it is allowed to deposit bismuth on the left-hand wall E of each hole. While, the peripheral portion B' of FIG. 4 is bombarded with the electron beam, as indicated by reference numeral 13' in FIG. 5. Accordingly, the bismuth layer 5 is formed on the peripheral portion B' in such a manner that bismuth is not deposited on the left-hand wall of each hole but may be deposited on the right-hand wall of each hole.

Further, in a case where bismuth is evaporated by resistance heating in vacuum, bumping may occur for the following reason. That is, owing to the wettability of a heating vessel such as the tungsten boat with bismuth, the evaporation of bismuth does not proceed smoothly, and thus bumping takes place. This problem can be solved by adding aluminum to bismuth so that the aluminum content is about one-tenth the bismuth content by weight, since aluminum has good wettability to the tungsten boat heater.

In some cases, the bismuth layer 5 formed on the shadow mask 3 is melted and forms a sphere in the manufacturing process of the cathode ray tube, since the melting point of bismuth is about 270° C. This problem can be solved by forming a nickel layer, in addition to the bismuth layer. The nickel layer can be formed by four methods. That is, (a) the nickel layer is deposited, as a ground coat, on an iron plate serving as the shadow mask 3, (b) an alloy layer made of bismuth and nickel is substituted for the bismuth layer and nickel layer, (c) the nickel layer is deposited on the bismuth layer, and (d) a combination of the above methods is used. Of these methods the third method (that is, the deposition of the nickel layer on the bismuth layer) is most effective.

In the present embodiment, bismuth is evaporated in vacuum by resistance heating, to form the bismuth layer 5. However, the deposition of bismuth on the shadow mask is not limited to resistance heating, but bismuth may be deposited on the shadow mask by electron beam heating, sputtering, and others.

As has been explained in the foregoing, according to the present invention, bismuth can be deposited on the shadow mask in a simple manner. Thus, the color unbalance due to the doming phenomenon of the shadow mask can be utterly prevented.

Further, according to the present invention, a material having a low thermal conductivity is deposited only on a peripheral portion of the shadow mask to reduce the manufacturing cost of a color cathode ray tube.

I claim:

1. A color cathode ray tube of the shadow mask type, comprising a shadow mask coated with a material having a low thermal conductivity, the material having a low thermal conductivity being vacuum-deposited mainly on a peripheral portion of a main surface of the shadow mask.

2. A color cathode ray tube according to claim 1, wherein the material having a low thermal conductivity is bismuth.

3. A color cathode ray tube according to claim 1, wherein the width of the peripheral portion is about one-third the width of the shadow mask in a lengthwise direction.

4. A color cathode ray tube according to claim 1, wherein the material having a low thermal conductivity is not deposited on such side wall of each of electron-beam transmitting holes of the shadow mask that faces to electron guns.

5. A color cathode ray tube according to claim 1, wherein the shadow mask is made of a material having a small coefficient of thermal expansion.

6. A color cathode ray tube according to claim 5, wherein the material having a small coefficient of thermal expansion is a nickel-iron alloy.

7. A color cathode ray tube according to claim 2, wherein bismuth is deposited on the main surface of the shadow mask to a thickness of 2 μm or less.

8. A color cathode ray tube according to claim 2, wherein nickel is deposited, in addition to bismuth.

9. A color cathode ray tube of the shadow mask type, comprising:

a bulb having a panel portion and a funnel portion;

an electron gun mounted at said funnel portion of said bulb; and a shadow mask located adjacent said panel portion of said bulb and between said panel portion and said electron gun, said shadow mask having opposing first and second major surfaces wherein said first major surface faces said panel portion and said second major surface faces said electron gun and having a plurality of electron beam transmitting holes extending through said shadow mask from said second major surface to said first major surface;

wherein said shadow mask has a vacuum-deposited material having a low thermal conductivity coated on said second major surface at least at a peripheral portion thereof; and wherein the electron beam transmitting holes located at said peripheral portion have a first side wall portion bombarded by electron beams from said electron beam gun and an opposite second side wall portion not bombarded by said electron beams, said first side wall portion being free of said vacuum-deposited material and said second side wall portion being coated with said vacuum-deposited material.

10. A color cathode ray tube according to claim 9, wherein a central portion of said shadow mask within said peripheral portion is not coated with said vacuum-deposited material.

11. A color cathode ray tube according to claim 10, wherein a width of said central portion is about $\frac{1}{3}$ the width of said shadow mask in a lengthwise direction.

12. A color cathode ray tube according to claim 10, wherein a thickness of said vacuum-deposited material in a portion joining said peripheral portion and said central portion gradually decreases from said peripheral portion to said central portion.

13. A color cathode ray tube according to claim 9, wherein said vacuum-deposited material comprises bismuth.

14. A color cathode ray tube according to claim 13, wherein said vacuum-deposited material further includes aluminum.

15. A color cathode ray tube according to claim 13, wherein at least a peripheral portion of said shadow mask is also coated with nickel.

16. A color cathode ray tube according to claim 15, wherein said shadow mask is provided at least a peripheral portion thereof with a nickel layer between said shadow mask and said vacuum-deposited material.

17. A color cathode ray tube according to claim 15, wherein said shadow mask is provided at least at a peripheral portion thereof with a vacuum-deposited material made of an alloy comprising bismuth and nickel.

18. A color cathode ray tube according to claim 15, wherein said shadow mask is provided at least at a peripheral portion thereof with a nickel layer over said vacuum-deposited material.

19. A color cathode ray tube according to claim 9, wherein said vacuum-deposited material is coated to a thickness of $2\mu m$ or less.

* * * * *